US008639500B2

(12) United States Patent
Choo et al.

(10) Patent No.: US 8,639,500 B2
(45) Date of Patent: Jan. 28, 2014

(54) METHOD, MEDIUM, AND APPARATUS WITH BANDWIDTH EXTENSION ENCODING AND/OR DECODING

(75) Inventors: Ki-hyun Choo, Seoul (KR); Eun-mi Oh, Seongnam-si (KR); Miao Lei, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1200 days.

(21) Appl. No.: 11/980,643

(22) Filed: Oct. 31, 2007

(65) Prior Publication Data

US 2008/0120117 A1 May 22, 2008

(30) Foreign Application Priority Data

Nov. 17, 2006 (KR) ..... 10-2006-0114101
May 11, 2007 (KR) ..... 10-2007-0046203

(51) Int. Cl.
*G10L 19/00* (2006.01)

(52) U.S. Cl.
USPC ..... 704/219

(58) Field of Classification Search
USPC ..... 704/205, 219, 225
See application file for complete search history.

(56) References Cited

U.S. PATENT DOCUMENTS 5,455,888 A 10/1995 Iyengar et al.
6,675,144 B1 * 1/2004 Tucker et al. ..... 704/264
6,889,182 B2 * 5/2005 Gustafsson ..... 704/205
7,864,843 B2 * 1/2011 Choo et al. ..... 375/240.12
2001/0044722 A1 * 11/2001 Gustafsson et al. ..... 704/258
2002/0128839 A1 * 9/2002 Lindgren et al. ..... 704/258
2003/0093271 A1 * 5/2003 Tsushima et al. ..... 704/230
2003/0093278 A1 * 5/2003 Malah ..... 704/265
2003/0233234 A1 * 12/2003 Truman et al. ..... 704/256
2003/0233236 A1 * 12/2003 Davidson et al. ..... 704/258
2004/0019492 A1 * 1/2004 Tucker et al. ..... 704/500
2004/0267522 A1 * 12/2004 Allamanche et al. ..... 704/205
2005/0004793 A1 * 1/2005 Ojala et al. ..... 704/219
2005/0065783 A1 * 3/2005 Ojala et al. ..... 704/205
2005/0246164 A1 * 11/2005 Ojala et al. ..... 704/205
2006/0277038 A1 * 12/2006 Vos et al. ..... 704/219
2006/0277039 A1 * 12/2006 Vos et al. ..... 704/219

(Continued)

FOREIGN PATENT DOCUMENTS

WO 03/044777 A1 5/2003
WO 2006/107837 A1 10/2006

OTHER PUBLICATIONS

Qian, Y. et al. "Combining Equalization and Estimation for Bandwidth Extension of Narrowband Speech" In: Proceedings of the 2004 IEEE International Conference on Acoustics, Speech, and Signal Processing. IEEE, May 17, 2004, vol. 1. See pp. I-713-716.
International Search Report issued on Feb. 12, 2008 in corresponding International Patent Application PCT/KR2007/005626.
Chinese Office Action dated Aug. 23, 2011, corresponds to Chinese Patent Application No. 200780048069.x.

(Continued)

*Primary Examiner* — Michael N Opsasnick
(74) *Attorney, Agent, or Firm* — Staas & Halsey LLP

(57) ABSTRACT

A method, medium, and apparatus encoding and/or decoding audio signals. By encoding and/or decoding a high-frequency signal using an excitation signal extracted from a low-frequency signal, coding efficiency can be maximized because sound quality of a signal corresponding to a high-frequency region does not deteriorate when audio signals are encoded or decoded using a low bit amounts or rates.

31 Claims, 5 Drawing Sheets

(56) References Cited

U.S. PATENT DOCUMENTS

| | | | | |
|---|---|---|---|---|
| 2006/0277042 | A1* | 12/2006 | Vos et al. | 704/223 |
| 2007/0225971 | A1* | 9/2007 | Bessette | 704/203 |
| 2007/0296614 | A1* | 12/2007 | Lee et al. | 341/50 |
| 2008/0027717 | A1* | 1/2008 | Rajendran et al. | 704/210 |
| 2009/0024399 | A1* | 1/2009 | Gartner et al. | 704/500 |
| 2009/0157393 | A1* | 6/2009 | Tsushima et al. | 704/203 |
| 2010/0274558 | A1* | 10/2010 | Yamanashi et al. | 704/219 |

OTHER PUBLICATIONS

Chinese Office Action issued Mar. 31, 2012 in corresponding Chinese Patent Application No. 200780048069.X.

Chinese Office Action issued Nov. 16, 2012 in corresponding Chinese Application No. 200780048069.

Korean Office Action issued in corresponding Korean Application No. 10-2007- 0046203 dated Jul. 4, 2013.

* cited by examiner

METHOD, MEDIUM, AND APPARATUS WITH BANDWIDTH EXTENSION ENCODING AND/OR DECODING

CROSS-REFERENCE TO RELATED APPLICATIONS

This application claims the benefit of Korean Patent Application Nos. 10-2006-0114101, filed on Nov. 17, 2006, and 10-2007-0046203, filed on May 11, 2007, in the Korean Intellectual Property Office, the disclosures of which are incorporated herein in their entirety by reference.

BACKGROUND

Field

One or more embodiments of the present invention relate to a method, medium, and apparatus encoding and/or decoding audio signals, such as voice signals or music signals, and more particularly, to a method, medium, and apparatus encoding and/or decoding signals corresponding to high-frequency regions in audio signals.

In general, high-frequency regions of audio signals typically have lower perceived human recognition importance than corresponding low-frequency regions. Accordingly, when emphasizing coding efficiency, e.g., due to limited permitted availability of bits, an encoding of both high and low frequencies may purposefully result in a larger number of bits being assigned to signals corresponding to low-frequency regions than assigned to signals corresponding to high-frequency regions, i.e., the encoding emphasis may be focused on the low-frequency regions. Similarly, with the reduction in the high-frequency region bits, transmission of a resultant encoded signal may have a lower bit rate than an encoded signal having the same number of bits assigned to both high and low-frequency regions.

Accordingly, the present inventors have discovered that, when signals corresponding to high-frequency regions are correspondingly encoded, there is a desire for a method, medium, and apparatus providing a maximum or increased sound quality, even in the high frequencies, that can be recognized by humans using a small or as small amount of bits as possible.

SUMMARY

One or more embodiments of the present invention provide a method, medium, and apparatus encoding and/or decoding a high-frequency signal with an excitation signal of a low-frequency signal.

Additional aspects and/or advantages will be set forth in part in the description which follows and, in part, will be apparent from the description, or may be learned by practice of the invention.

According to an aspect of the present invention, there is provided a bandwidth extension encoding method including removing an envelope from a low-frequency signal wherein the low-frequency signal belongs to a frequency region whose frequencies are lower than a predetermined frequency to extract an excitation signal from the low-frequency signal and transform the excitation signal to a frequency domain; generating a spectrum which belongs to a region whose frequencies are higher than the predetermined frequency by processing a spectrum of the excitation signal; and comparing the generated spectrum with a spectrum of a high-frequency signal corresponding to the region whose frequencies are higher than the predetermined frequency, and calculating a gain value.

According to another aspect of the present invention, there is provided a bandwidth extension decoding method including removing an envelope from a low-frequency signal wherein the low-frequency signal belongs to a frequency region whose frequencies are lower than a predetermined frequency to extract an excitation signal and transform the excitation signal to a frequency domain; generating a spectrum which belongs to a region whose frequencies are higher than the predetermined frequency by processing a spectrum of the excitation signal; and decoding a gain value, and applying the gain value to the generated spectrum.

According to another aspect of the present invention, there is provided a bandwidth extension encoding apparatus including an excitation signal extractor removing an envelope from a low-frequency signal wherein the low-frequency signal belongs to a frequency region whose frequencies are lower than a predetermined frequency, to extract an excitation signal, and transforming the excitation signal to a frequency domain; a spectrum generator generating a spectrum which belongs to a frequency region whose frequencies are higher than the predetermined frequency, by processing a spectrum of the excitation signal; and a gain value calculator comparing the generated spectrum with a spectrum of a high-frequency signal corresponding to a region whose frequencies are higher than the predetermined frequency, and calculating a gain value.

According to another aspect of the present invention, there is provided a bandwidth extension decoding apparatus including an excitation signal extractor removing an envelope from a low-frequency signal wherein the low-frequency signal belongs to a frequency region whose frequencies are lower than a predetermined frequency, to extract an excitation signal, and transforming the excitation signal to a frequency domain; a spectrum generator generating a spectrum which belongs to a frequency region whose frequencies are higher than the predetermined frequency, by processing a spectrum of the transformed excitation signal; and a spectrum applying unit decoding a gain value, and applying the decoded gain value to the generated spectrum.

According to another aspect of the present invention, there is provided A computer-readable recording medium having embodied thereon a program for executing a method including removing an envelope from a low-frequency signal wherein the low-frequency signal belongs to a frequency region whose frequencies are lower than a predetermined frequency, to extract an excitation signal, and transforming the excitation signal to a frequency domain; generating a spectrum which belongs to a region whose frequencies are higher than the predetermined frequency, by processing a spectrum of the excitation signal; and comparing the generated spectrum with a spectrum of a high-frequency signal corresponding to a region whose frequencies are higher than the predetermined frequency, and calculating a gain value.

According to another aspect of the present invention, there is provided a computer-readable recording medium having embodied thereon a program for executing a method including removing an envelope from a low-frequency signal wherein the low-frequency signal belongs to a frequency region whose frequencies are lower than a predetermined frequency, to extract an excitation signal, and transforming the excitation signal to a frequency domain; generating a spectrum which belongs to a frequency region whose frequencies are higher than the predetermined frequency, by processing a spectrum of the excitation signal; and decoding a gain value, and applying the gain value to the generated spectrum.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
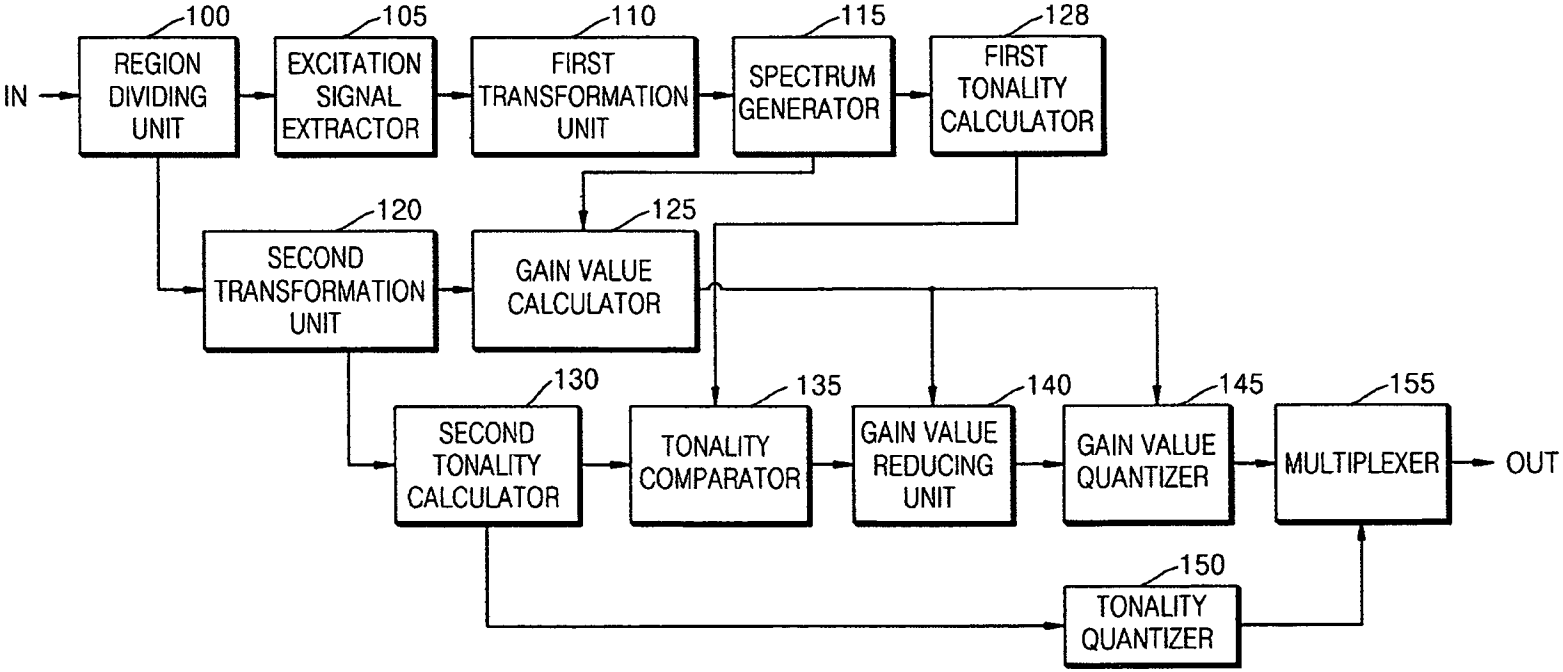
FIG. 1 illustrates a bandwidth extension encoding apparatus, according to an embodiment of the present invention.

Reference will now be made in detail to embodiments, examples of which are illustrated in the accompanying drawings, wherein like reference numerals refer to like elements throughout. In this regard, embodiments of the present invention may be embodied in many different forms and should not be construed as being limited to embodiments set forth herein. Accordingly, embodiments are merely described below, by referring to the figures, to explain aspects of the present invention.

FIG. 1 illustrates a bandwidth extension encoding apparatus, according to an embodiment of the present invention. Herein, the term apparatus should be considered synonymous with the term system, and not limited to a single enclosure or all described elements embodied in single respective enclosures in all embodiments, but rather, depending on embodiment, is open to being embodied together or separately in differing enclosures and/or locations through differing elements, e.g., a respective apparatus/system could be a single processing element or implemented through a distributed network, noting that additional and alternative embodiments are equally available.

Referring to FIG. 1, the bandwidth extension encoding apparatus may include a region dividing unit 100, an excitation signal extractor 105, a first transformation unit 110, a spectrum generator 115, a second transformation unit 120, a gain value calculator 125, a first tonality calculator 128, a second tonality calculator 130, a tonality comparator 135, a gain value reducing unit 140, a gain value quantizer 145, a tonality quantizer 150, and a multiplexer 155, for example.

The region dividing unit 100 may receive a signal, e.g., through an input terminal IN, and divide the signal into a high-frequency signal and a low-frequency signal on the basis of a predetermined frequency, for example. In an embodiment, the low-frequency signal belongs to a frequency region whose frequencies are lower than a first predetermined frequency, and the high-frequency signal belongs to a frequency region whose frequencies are higher than a second predetermined frequency. In one embodiment, the first and second predetermined frequencies may preferably be set to the same value, while the first and second predetermined frequencies may equally be set to different values.

The excitation signal extractor 105 may remove an envelope from the low-frequency signal, e.g., obtained from the region dividing unit 100, thus extracting an "excitation signal" from the low-frequency signal. The excitation signal extractor 105 can remove the envelope from the low-frequency signal by performing Linear Predictive Coding (LPC) analysis, thus extracting the excitation signal from the low-frequency signal, for example. The term "excitation signal" may be considered a result of a predictive analysis of an input signal, based upon the premise that an audio sample can be approximated through linear combinations of previous samples within the audio sample. For example, an LPC analysis of an audio signal may attempt to predict a value based upon a linear combination of previous samples, with an error thereof being a difference between the actual current value and the predicted value. Here, the linear prediction coefficients used to predict the value in the LPC analysis can then be changed to minimize or selectively generate this error. The eventual error though may be output as the "excitation signal." By knowing linear prediction coefficients, the original audio signal may be generated by a decoder running an inverse prediction filter based upon an input of the excitation signal.

Thus, accordingly, the first transformation unit 110 may transform the resultant excitation signal, from the low frequency signal, from a time domain to a frequency domain. For example, the first transformation unit 110 may transform the excitation signal from the time domain to the frequency domain by performing Fast Fourier Transformation (FFT) on the excitation signal, wherein the FFT may be 288 point FFT including overlapping of 32 samples, among any one of 288 point FFT, 576 point FFT, or 1152 point FFT, for example. In an embodiment, if a transformation technique using overlapping is used to encode the low-frequency signal, the first transformation unit 110 may preferably use a technique of setting a window and performing overlapping so that a decoder can completely restore the low-frequency signal. However, the first transformation unit 110 may use a different transformation technique other than the FFT for transforming the excitation signal from the time domain to the frequency domain. For example, the first transformation unit 110 may use a transformation technique such as Quadrature Mirror Filterbank (QMF), where a predetermined signal is represented by the time domain for each of a plurality of predetermined frequency bands.

The spectrum generator 115 may generate a spectrum in the high-frequency region, e.g., the region whose frequencies are higher than the second predetermined frequency, by processing the spectrum of the extracted excitation signal of the low frequency region. For example, the spectrum generator 115 may generate a spectrum in the high-frequency region by patching a spectrum of the extracted excitation signal to the high-frequency region or by symmetrically folding a spectrum of the extracted excitation signal with respect to the example predetermined frequency used in setting the separation between the low and high-frequency regions.

The second transformation unit 120 may transform the high-frequency signal obtained from the region dividing unit 100 from the time domain to the frequency domain. For example, the second transformation unit 120 may transform the high-frequency signal from the time domain to the frequency domain by performing FFT on the high-frequency signal, wherein the FFT may be 288 point FFT including overlapping of 32 samples among any one of 288 point FFT, 576 point FFT, or 1152 point FFT, for example. In addition, if a transformation technique using overlapping is used to encode the high-frequency signal, the second transformation unit 120 may preferably use a technique of setting a window and performing overlapping so that a decoder can completely restore the high-frequency signal, for example. However, it is further noted that the second transformation unit 120 may use a different transformation technique other than the FFT for transforming the time domain to the frequency domain. As only an example, the second transformation unit 120 may use a transformation technique such as QMF, where a predetermined signal is represented by a time domain for each of a plurality of predetermined frequency bands.

The gain value calculator 125 may further calculate an energy ratio for each predetermined band within the spectrum of the high-frequency signal as transformed by the second transformation unit 120 and the spectrum for the high-frequency region generated by the spectrum generator 115 in order to obtain a gain value.

The first tonality calculator 128 may calculate a tonality of the spectrum for the high-frequency region generated by the spectrum generator 115, in units of predetermined bands. The first tonality calculator 128 may calculate the tonality of the spectrum using a Spectral Flatness Measure (SFM) value, for example. In an embodiment, the tonality becomes the value obtained by subtracting the corresponding SFM value from 1.

The second tonality calculator 130 may calculate a tonality of the spectrum of the high-frequency signal as transformed by the second transformation unit 120, in units of predetermined bands.

The tonality comparator 135 may, thus, compare the tonality calculated by the first tonality calculator 128 with the tonality calculated by the second tonality calculator 130.

The gain value reducing unit 140 may then reduce the gain value calculated by the gain value calculator 125 with the energy ratio of the tonality calculated by the second tonality calculator 130 with respect to the tonality calculated by the first tonality calculator 128, for a band (bands) in which the tonality comparator 135 determines that the tonality calculated by the second tonality calculator 130 is larger than the tonality calculated by the first tonality calculator 128. A reason for the gain value reducing unit 140 to reduce the gain value for a predetermined band(s) is to make an amount of noise of a high-frequency signal generated by a decoder, for example, to be similar to an amount of noise of a target high-frequency signal.

The gain value reducing unit 140 may, thus, reduce the gain value by using the below Equations 1 and 2, for example.

$$\text{Scale} = \sqrt{\frac{1-\text{Tonality}(HB)}{1-\text{Tonality}(LB)}} = \sqrt{\frac{SFM(HB)}{SFM(LB)}} \qquad \text{Equation 1}$$

Here, in this example, Tonality(HB) represents the tonality calculated by the second tonality calculator 130, Tonality (LB) represents the tonality calculated by the first tonality calculator 128, SFM(HB) represents the SFM value for the spectrum of the high-frequency signal as transformed by the second transformation unit 120, and SFM(LB) represents the SFM value for the spectrum generated by the spectrum generator 115.

$$\text{gain}'=\text{scale}*\text{gain} \qquad \text{Equation 2}$$

Here, again in this example, gain' represents the gain value of the predetermined band reduced by the gain value reducing unit 140, scale represents the ratio of the tonality calculated by the second tonality calculator 130 with respect to the tonality calculated according to Equation 1 by the first tonality calculator 128, and gain represents the gain value of the predetermined band calculated by the gain value calculator 125.

The gain value quantizer 145 may further quantize the gain value reduced by the gain value reducing unit 140, for a band (bands) whose gain value is reduced.

Here, in an embodiment, the gain value quantizer 145 quantizes the gain value calculated by the gain value calculator 125, for a band (bands) in which the tonality comparator 135 determines that the tonality calculated by the second tonality calculator 130 is less than the tonality calculated by the first tonality calculator 128, that is, for a band (bands) in which no gain value is reduced by the gain value reducing unit 140.

The tonality quantizer 150 may quantize a tonality for each band of the spectrum of the high-frequency signal calculated by the second tonality calculator 130.

The multiplexer 155 then may multiplex the gain value quantized by the gain value quantizer 145 with the tonality quantized by the tonality quantizer 150, generate a bit stream, and output the bit stream through an output terminal OUT, for example.

Figure 2:
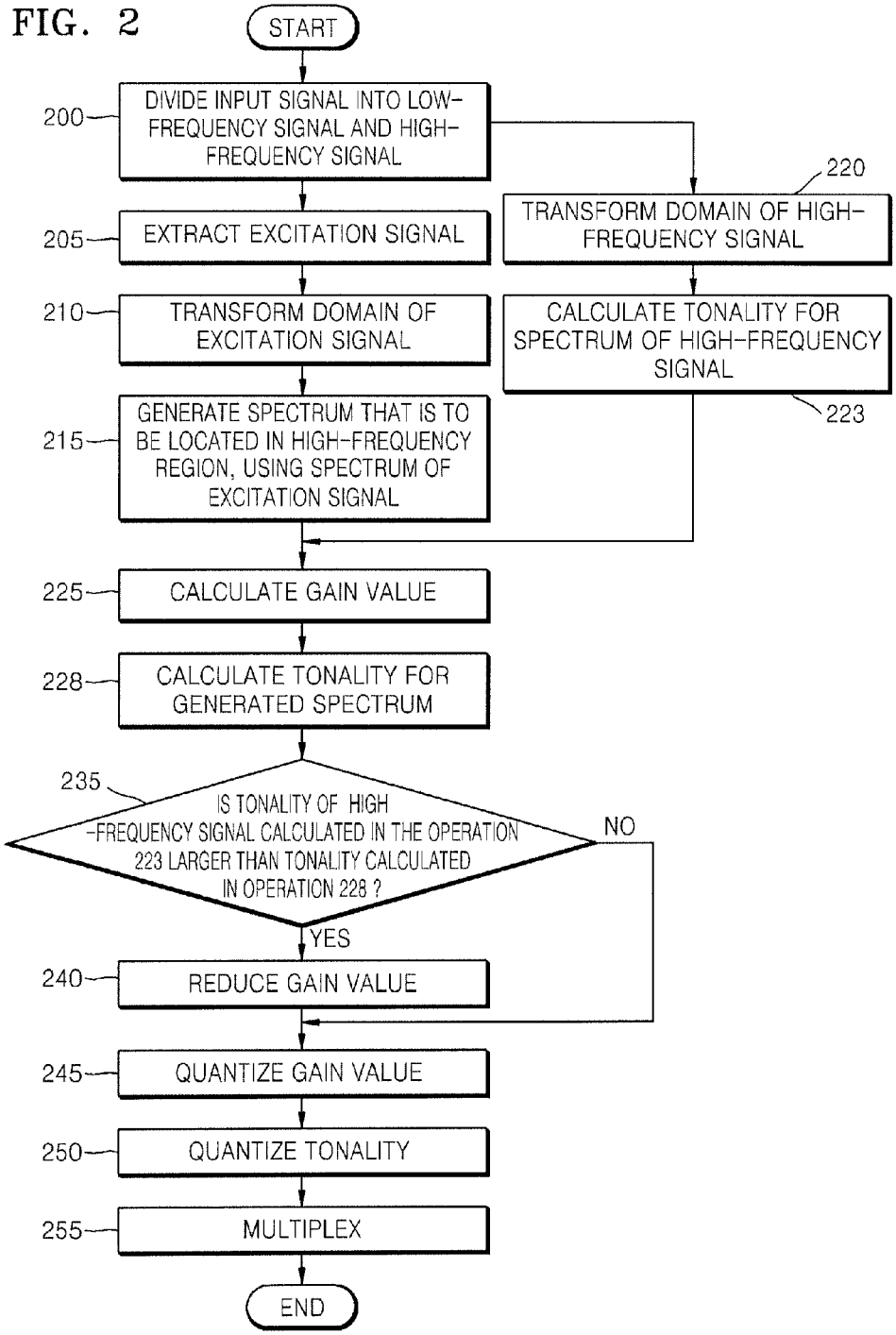
FIG. 2 illustrates a bandwidth extension encoding method, according to an embodiment of the present invention.

FIG. 2 illustrates a bandwidth extension encoding method, according to an embodiment of the present invention.

First, an input signal may be divided into a low-frequency signal and a high-frequency signal based on a predetermined frequency, in operation 200. Here, the low-frequency signal may be set to belong to a frequency region whose frequencies are lower than a first predetermined frequency, and the high-frequency signal may be set to belong to a frequency region whose frequencies are higher than a second predetermined frequency. According to an embodiment, the first and second predetermined frequencies may preferably be set to the same value, i.e., the predetermined frequency; however, the first and second frequencies may also be set to different values in differing embodiments.

Then, an envelope may be removed from the low-frequency signal, so that an excitation signal is extracted from the low-frequency signal, in operation 205. The envelope can be removed from the low-frequency signal by performing LPC analysis on the low-frequency signal, so that the excitation signal can be extracted from the low-frequency signal.

Then, the excitation signal of the low-frequency signal may be transformed from the time domain to the frequency domain, in operation 210. For example, in operation 210, Fast Fourier Transformation (FFT) can be used, wherein the FFT may be 288 point FFT including overlapping of 32 samples among any one of 288 point FFT, 576 point FFT, or 1152 point FFT, for example. In an embodiment, if a transformation technique using overlapping is used to encode the low-frequency signal, a technique of setting a window and performing overlapping so that a decoder can completely restore the low-frequency signal may be used. However, in operation 210, a different transformation technique other than FFT may also be used for transforming the time domain to the frequency domain. For example, in operation 210, the transformation technique may be a QMF technique, where the time domain is represented for a each of a plurality of predetermined frequency bands.

Then, by processing the spectrum of the excitation signal, a spectrum for the high-frequency region whose frequencies are higher than the predetermined second frequency may be generated, in operation 215. For example, in operation 215, the spectrum of the high-frequency region can be generated by patching the spectrum of the extracted excitation signal, extracted from the low frequency signal, to a high frequency domain or by symmetrically folding the spectrum of the extracted excitation signal with respect to a predetermined frequency.

Next, the high-frequency signal obtained in operation 200 may be transformed from the time domain to the frequency domain, in operation 220. For example, a technique for transforming the high-frequency signal to the frequency domain in operation 220 may be FFT, wherein the FFT may be 288 point FFT including overlapping of 32 samples, among any one of 288 point FFT, 576 point FFT, or 1152 point FFT, for example. In an embodiment, if a transformation technique using overlapping is used to encode the high-frequency signal, when overlapping is performed in operation 220, a technique of setting a window and performing overlapping so that a decoder can completely restore the high-frequency signal may be used. However, in operation 220, a different transformation technique other than FFT for transforming the time domain to the frequency domain may be used. For example, in operation 220, the transformation technique may be a QMF technique, where a predetermined signal is represented by the time domain for each of a plurality of predetermined frequency bands.

The tonality for a spectrum of the transformed high-frequency signal, e.g., produced in operation 220, may then be calculated in units of predetermined bands, in operation 223. In order to calculate the tonality, as noted above, SFM can be utilized. In an embodiment, in such a case of calculating the tonality with the SFM, the tonality may be the value obtained by subtracting the corresponding SFM value from 1, for example.

By calculating an energy ratio of the spectrum of the high-frequency signal transformed in operation 220, with respect to the spectrum generated in operation 215, for each predetermined band, a corresponding gain value may be calculated, in operation 225.

Further, the tonality of the spectrum generated in operation 215 may be calculated in units of predetermined bands, in operation 228.

The tonality calculated in operation 228 may further be compared with the tonality for the high-frequency signal calculated in operation 223, in operation 235.

Thus, in an embodiment, in the case of a band (bands) in which the tonality of the high-frequency signal calculated in the operation 223 is larger than the tonality calculated in operation 228, the gain value calculated in operation 225 may be reduced according to the ratio of the tonality calculated in operation 223 with respect to the tonality calculated in operation 228, in operation 240. Here, the gain value for a predetermined band (bands) may be reduced in operation 240 in order to make the amount of noise of a high-frequency signal generated by a decoder, for example, to be similar to the amount of noise of a target noise signal.

In operation 240, the gain value may be reduced by using the below Equations 3 and 4, for example.

$$\text{Scale} = \sqrt{\frac{1-\text{Tonality}(HB)}{1-\text{Tonality}(LB)}} = \sqrt{\frac{SFM(HB)}{SFM(LB)}} \qquad \text{Equation 3}$$

Here, Tonality(HB) represents the tonality calculated in operation 223, Tonality(LB) represents the tonality calculated in operation 228, SFM(HB) represents the SFM value for the spectrum of the high-frequency signal, and SFM(LB) represents the SFM value for the spectrum in operation 215.

$$\text{gain}' = \text{scale} * \text{gain} \qquad \text{Equation 4}$$

Here, gain' represents the gain value of the predetermined band reduced in operation 240, scale represents the ratio of the tonality calculated in operation 223 with respect to the tonality calculated in operation 228 according to Equation 3 by the first tonality calculator 128, and gain represents the gain value of the predetermined band calculated by operation 225.

Thereafter, the gain value reduced in operation 240 may be calculated for a band (bands) whose gain value is reduced, in operation 245.

In the case of a band (bands) in which the tonality of the high-frequency signal calculated in operation 223 is larger than the tonality calculated in operation 228, the gain value calculated in operation 225 may be quantized.

The tonality for each band of the spectrum of the high-frequency signal calculated in operation 223 may further be quantized, in operation 250.

Thus, by multiplexing the gain value quantized in operation 245 with the tonality quantized in operation 250, a resultant bit steam may further be generated, in operation 255.

Figure 3:
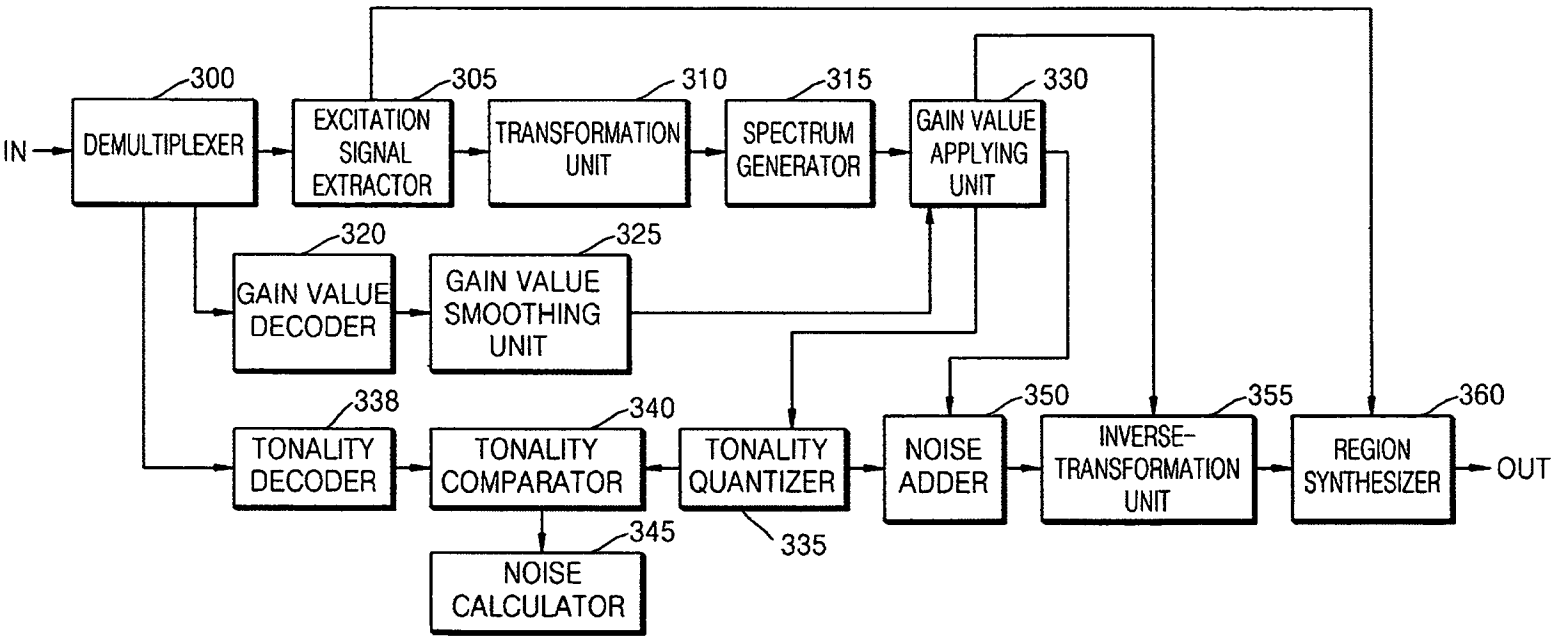
FIG. 3 illustrates a bandwidth extension decoding apparatus, according to an embodiment of the present invention.

FIG. 3 illustrates a bandwidth extension decoding apparatus, according to an embodiment of the present invention. Referring to FIG. 3, the band extension decoding apparatus may include a demultiplexer 300, an excitation signal extractor 305, a converter 310, a spectrum folding unit 315, a gain value decoder 320, a gain value smoothing unit 325, a gain value applying unit 330, a tonality calculator 335, a tonality decoder 338, a tonality comparator 340, a noise calculator 345, a noise adder 350, an inverse transformation unit 355, and a region synthesizer 360, for example.

The demultiplexer 300 may receive a bit stream, e.g., from an encoder through its input terminal, and demultiplex the bit stream. Here, the demultiplexer 300 may demultiplex the bit stream to separate included respective gain values of each band of a region whose frequencies are higher than an example predetermined frequency, a tonality for each band of a region whose frequencies are higher than the predetermined frequency, and a low-frequency signal encoded by the encoder. Here, in an embodiment, the low-frequency signal may belong to a region whose frequencies are lower than a first predetermined frequency, such that a corresponding high-frequency signal may be a region whose frequencies are higher than a second predetermined frequency. In such an embodiment, the first predetermined frequency may preferably be equal to the second predetermined frequency; however, the first and second predetermined frequencies may also be set to different values.

The excitation signal extractor 305 may receive the demultiplexed low-frequency signal, decode the low-frequency signal, remove an envelope from the decoded low-frequency signal, and extract an excitation signal from the low-frequency signal. At that time, the excitation signal extractor 305 may extract the excitation signal by performing an LPC analysis on the decoded low-frequency signal to remove an envelope from the low-frequency signal. The excitation signal extractor 305 may, thus, extract the excitation signal by using a technique which is used by a decoder to extract an excitation signal. Here, the excitation signal extractor 305 may further output the decoded low-frequency signal to the region synthesizer 355 and output the extracted excitation signal to the transformation unit 310.

The transformation unit 310 may transform the extracted excitation signal of the low-frequency signal from the time domain to the frequency domain. For example, the transformation unit 310 can transform the excitation signal to the frequency domain by performing FFT on the excitation signal, wherein the FFT may be 288 point FFT including overlapping of 32 samples, among any one of the 288 point FFT, 576 point FFT, or 1152 point FFT, for example. In an embodiment, if the transformation technique using overlapping was used to encode a low-frequency signal, the transformation unit 310 may preferably use a technique of setting a window and performing overlapping so that the decoder can completely restore the low-frequency signal. However, the transformation unit 310 may use a different transformation technique, other than FFT, for transforming the time domain to the frequency domain. For example, in an embodiment, the transformation unit 310 may use a transformation technique such as QMF, where a predetermined signal is represented by the time domain for each of a plurality of predetermined frequency bands.

The spectrum generator 315 may generate a spectrum of a high-frequency region, a spectrum of frequencies higher than the predetermined frequency, or the aforementioned second predetermined frequency, by processing the spectrum of the excitation signal transformed by the transformation unit 310. For example, the spectrum generator 315 may generate a spectrum of the high-frequency region by patching the spectrum of the extracted excitation signal, e.g., as transformed by the transformation unit 310, to the high-frequency region or by symmetrically folding the spectrum of the extracted excitation signal with respect to the predetermined frequency.

The gain value decoder 320 may receive and decode the encoded gain value from the demultiplexer 300.

The gain value smoothing unit 325 may further smooth the gain value in order to prevent the gain value from sharply changing between bands. Here, the gain value smoothing unit 325 may adjust the gain value by performing interpolation according to the frequency bin index between bands along the center of each band.

Figure 5:
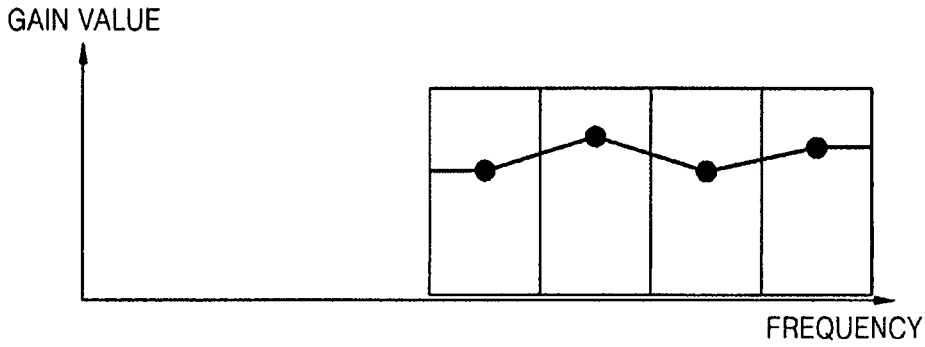
FIG. 5 shows a graph obtained when gain values for four sub-bands are smoothed, e.g., according to the bandwidth extension decoding illustrated in FIGS. 3 and 4, according to an embodiment of the present invention.

For example, an embodiment in which the gain value smoothing unit 325 smoothes gain values for four bands is illustrated in FIG. 5. The data points illustrated in FIG. 5 represent the gain values for the four bands, and the lines illustrated in FIG. 5 represent the smoothed gain values. However, in an embodiment, the gain value smoothing unit 325 may not be included in the bandwidth extension decoding apparatus.

The gain value application unit 330 may apply the smoothed gain value, e.g., as smoothed by the gain value smoothing unit 325, to the spectrum generated by the spectrum generator 315.

The tonality calculator 335 may further calculate the tonality of the spectrum to which the gain value is applied by the gain value application unit 330.

The tonality decoder 338 may receive the tonality of each band of a high-frequency region, e.g., corresponding to a region whose frequencies are higher than the aforementioned second frequency encoded by an encoder, from the demultiplexer 300, and decodes the tonality (or tonalities).

The tonality comparator 340 may compare the tonality for each band, e.g., as calculated by the tonality calculator 335, with the tonality for each band decoded by the tonality decoder 338.

In an embodiment, the noise calculator 345 may further calculate the amount of noise that causes the tonality for the spectrum of the high-frequency signal to be similar to the tonality decoded by the tonality decoder 338, for the band (bands) in which the tonality calculated by the tonality calculator 335 is larger than the tonality decoded by the tonality decoder 338. For example, the noise calculator 345 may calculate the amount of noise by using the below Equation 5, 6, and 7, for example.

$$\mathrm{Scale}_{LB}[i] = \sqrt{\frac{\mathrm{Tonality(Tag)}[i]}{\mathrm{Tonality}(Cur)[i]}} = \sqrt{\frac{SFM\,(\mathrm{Tag})[i]}{SFM\,(Cur)[i]}} \quad \text{Equation 5}$$

$$\mathrm{Scale}_{Noise}[i]=\sqrt{1-\mathrm{scale}_{LB}^{2}} \quad \text{Equation 6}$$

$$\mathrm{spec}[j]=\mathrm{scale}_{LB}[i]*\mathrm{spec}[j]+\mathrm{scale}_{Noise}[i]*\mathrm{noise}[j] \quad \text{Equation 7}$$

Here, i represents the band index, and j represents the spectral line index.

The noise adder 350 may, thus, add the amount of noise to the spectrum to which the gain value is applied by the gain value application unit 330.

The inverse-transformation unit 353 may then inverse-transform the spectrum to which the amount of noise has been added, e.g., by the noise adder 350, from the frequency domain to the time domain, for the band (bands) in which the tonality calculated by the tonality calculator 335 is larger than the tonality decoded by the tonality decoder 338. For example, the inverse-transformation unit 353 may be an Inverse Fast Fourier Transformation (IFFT), wherein the IFFT may be 288 point IFFT including overlapping of 32 samples, among any one of the 288 point IFFT, 576 point IFFT, or 1152 point IFFT, for example. In an embodiment, if a transformation technique using overlapping was used to encode a low-frequency signal, the inverse-transformation unit 353 may preferably use a technique of setting a window and performing overlapping so that a decoder can completely restore the low-frequency signal. However, such an inverse-transformation unit 353 may use a different transformation technique other than IFFT for transforming the frequency domain to the time domain. As only an example, the inverse-transformation unit 353 may use a transformation technique such as QMF.

Figure 6:
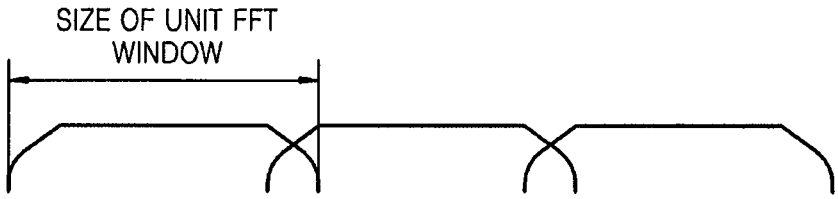
FIG. 6 illustrates a case wherein an overlapping is performed, e.g., according to the bandwidth extension decoding illustrated in FIGS. 3 and 4, according to an embodiment of the present invention.

Here, the inverse transformation unit 353 may, thus, perform overlapping as illustrated in FIG. 6. For example, if a transformation technique using overlapping was used to encode a low-frequency signal, the inverse-transformation unit 353 may preferably use a technique of setting a window and performing overlapping so that a decoder can completely restore the low-frequency signal.

In addition, the inverse transformation unit 353 may inverse-transform the spectrum to which the gain value is applied by the gain value application unit 330, from the frequency domain to the time domain, for the band (bands) in which the tonality calculated by the tonality calculator 335 is less than the tonality decoded by the tonality decoder 338.

The region synthesizer 355 may further locate the low-frequency signal decoded by the excitation signal extractor 305 in a region whose frequencies are lower than the aforementioned predetermined frequency, and locate the high-frequency signal inverse-transformed by the inverse transformation unit 353 in a region whose frequencies are higher than the example predetermined frequency, then synthesize the low-frequency signal with the high-frequency signal, and output the result of the synthesizing through an output terminal OUT.

Figure 4:
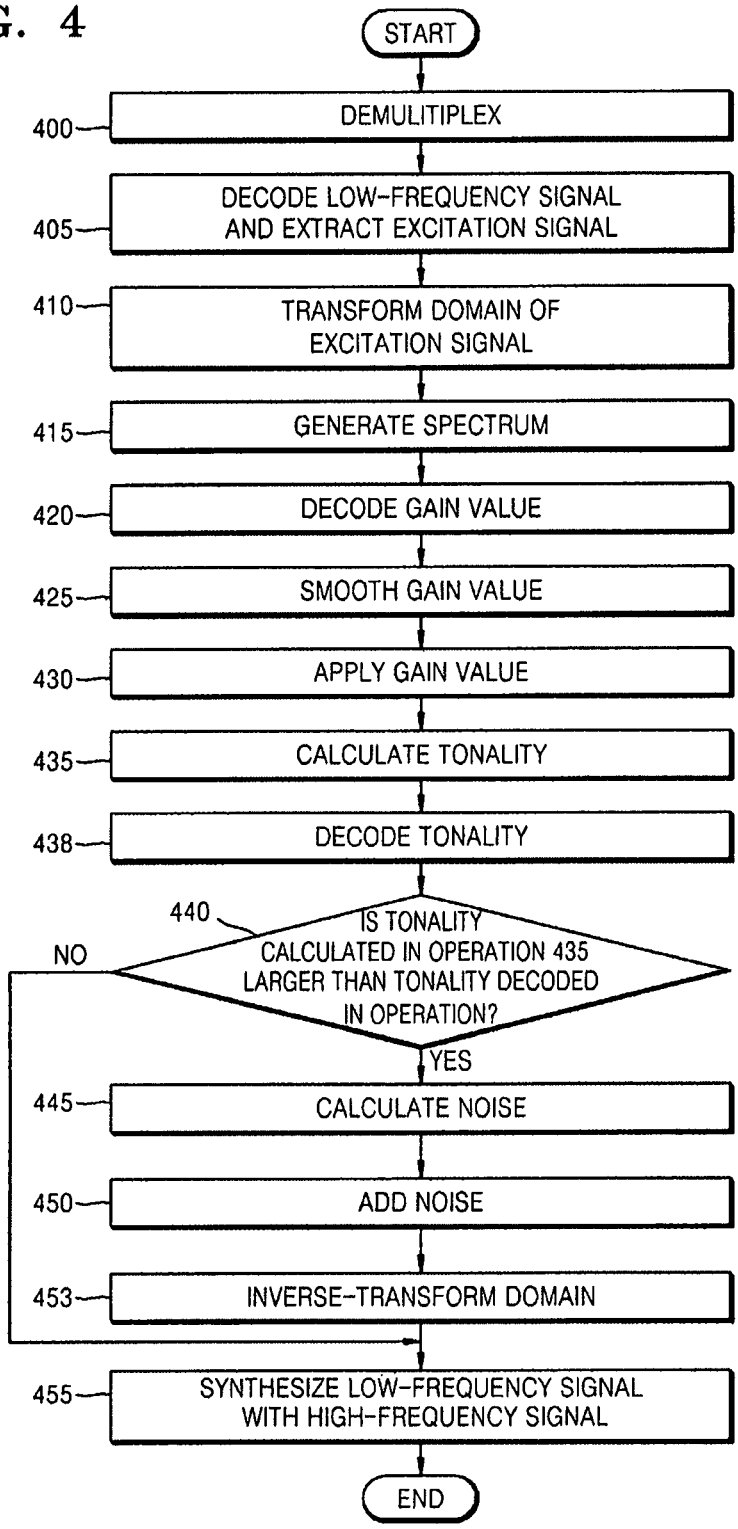
FIG. 4 illustrates a bandwidth extension decoding method, according to an embodiment of the present invention.

FIG. 4 illustrates a bandwidth extension decoding method, according to an embodiment of the present invention.

A bit stream may be received, e.g., from a decoder, and then demultiplexed, in operation 400. Here, the bit stream may include a gain value for each band of a region whose frequencies are higher than a predetermined frequency, a tonality for each band of a region whose frequencies are higher than the predetermined frequency, and a low-frequency signal encoded by an encoder. Here, in an embodiment, the low-frequency signal may belong to the region whose frequencies are lower than a first predetermined frequency, such that a corresponding high-frequency signal may be a region whose frequencies are higher than a second predetermined frequency. In such an embodiment, the first predetermined frequency may preferably be equal to the second predetermined frequency; however, the first and second predetermined frequencies may also be set to different values.

Then, the encoded low-frequency signal may be decoded, an envelope removed from the decoded low-frequency signal, and an excitation signal extracted from the low-frequency signal, in operation 405. At that time, the excitation signal may be extracted by performing LPC analysis on the low-frequency signal to remove the envelope from the low-frequency signal, for example. In operation 405, the excitation signal may preferably be extracted by the same technique as was performed by the encoder that generated the encoded low-frequency signal to extract a corresponding excitation signal.

The extracted excitation signal of the low-frequency signal may be transformed from the time domain to the frequency domain, in operation 410. For example, in operation 410, FFT can be used, wherein the FFT may be 288 point FFT including overlapping of 32 samples among any one of the 288 point FFT, 576 point FFT, or 1152 point FFT. In an embodiment, if the transformation technique using overlapping was used to encode the low-frequency signal, a technique of setting a window and performing overlapping so that a decoder can completely restore a low-frequency signal can be used. However, in operation 410, different transformation techniques other than FFT for transforming the time domain to the frequency domain may be used. For example, in operation 410, the transformation may be performed by a transformation technique such as QMF, where a predetermined signal is represented by the time domain for each of a plurality of predetermined frequency bands.

Accordingly, a spectrum may be generated in a high-frequency region whose frequencies are higher than the aforementioned predetermined frequency, e.g., the second predetermined frequency, by processing the spectrum of the excitation signal, in operation 415. For example, in operation 415, the spectrum of the high-frequency region may be generated by patching the spectrum of the excitation signal, transformed in operation 410 to the high-frequency region, or by symmetrically folding the spectrum of the excitation signal to the high-frequency region with respect to the predetermined frequency.

Then, the gain value encoded by the encoder may be decoded, in operation 420.

In order to prevent the gain value from sharply changing between bands, the gain value may further be smoothed, in operation 425. Here, for example, the gain value can be adjusted by performing interpolation according to a frequency bin index between bands along the center of each band.

For example, an embodiment in which the gain values are smoothed for four bands in operation 425 have been illustrated in FIG. 5. The data points illustrated in FIG. 5 represent the gain values for four bands, and lines illustrated in FIG. 5 represent gain values obtained by smoothing the gain values. However, as noted above, in an embodiment, such an operation 425 may not be included in the bandwidth extension decoding technique.

The smoothed gain value may be applied to the spectrum generated in operation 415, in operation 430.

Further, the tonality of the spectrum to which the gain value has been applied in operation 430 may be calculated, in operation 435.

The tonality for each band of the high-frequency region whose frequencies are higher than the predetermined frequency, or higher than the aforementioned second predetermined frequency, as encoded by the encoder, may thus be decoded, in operation 438.

The tonality for each band calculated in operation 435 may further be compared with the tonality for each band decoded in operation 438, in operation 440.

In the case of the band (bands) in which the tonality calculated in operation 435 is larger than the tonality decoded in operation 438, an amount of noise which causes the tonality of the spectrum of the high-frequency signal to be similar to the tonality decoded in operation 438 may be calculated, in operation 445. For example, in operation 445, the amount of noise may be calculated by using the below Equations 8, 9, and 10, for example.

$$\mathrm{Scale}_{LB}[i] = \sqrt{\frac{\mathrm{Tonality(Tag)}[i]}{\mathrm{Tonality}(Cur)[i]}} = \sqrt{\frac{SFM\ (\mathrm{Tag})[i]}{SFM\ (Cur)[i]}} \quad \text{Equation 8}$$

$$\mathrm{Scale}_{Noise}[i]=\sqrt{1-\mathrm{scale}_{LB}^{2}} \quad \text{Equation 9}$$

$$\mathrm{spec}[j]=\mathrm{scale}_{LB}[i]*\mathrm{spec}[j]+\mathrm{scale}_{Noise}[i]*\mathrm{noise}[j] \quad \text{Equation 10}$$

Here, i represents a band index, and j represents a spectral line index.

The amount of noise calculated in operation 445 may be added to the spectrum to which the gain value is applied in operation 430, in operation 450.

The spectrum to which the amount of noise has been added in operation 450 may be transformed from the frequency domain to the time domain, for the band (bands) in which the tonality calculated in operation 435 is larger than the tonality decoded in operation 438, in operation 453. For example, in operation 453, the transformation may be performed by an IFFT, wherein the IFFT may be 288 point IFFT including overlapping of 32 samples among any one of the 288 point IFFT, 576 point IFFT, or 1152 point IFFT, for example. In an embodiment, if a transformation technique using overlapping was used to encode the low-frequency signal, a technique of setting a window and performing overlapping so that the decoder can completely restore the low-frequency signal may be used. However, in operation 453, different transformation techniques other than IFFT for transforming the time domain to the frequency domain may also be used. For example, in operation 453, the transformation may be performed by a transformation technique such as QMF.

In operation 453, in an embodiment, overlapping may be performed as illustrated in FIG. 6. For example, if the transformation technique using overlapping was used to encode the low-frequency signal, a technique of setting a window and performing overlapping so that the decoder can completely restore the low-frequency signal may be used.

In addition, in operation 453, the spectrum to which the gain value was applied in operation 430 may be inverse-transformed from the frequency domain to the time domain, for the band (bands) in which the tonality calculated in operation 435 is less than the tonality decoded in operation 438.

Further, by locating the decoded low-frequency signal, e.g., decoded in operation 405, in a region whose frequencies are lower than the aforementioned predetermined frequency and locating the high-frequency signal, e.g., inverse-transformed in operation 453, in a region whose frequencies are higher than the predetermined frequency, the low-frequency signal may be multiplexed with the high-frequency signal, in operation 455, to output the combined high and low-frequency signal.

In addition to the above described embodiments, embodiments of the present invention can also be implemented through computer readable code/instructions in/on a recording medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including recording media, such as magnetic storage media (e.g., ROM, floppy disks, hard disks, etc.) and optical recording media (e.g., CD-ROMs, or DVDs), and transmission media such as media carrying or including carrier waves, as well as elements of the Internet, for example. Thus, the medium may be such a defined and measurable structure including or carrying a signal or information, such as a device carrying a bitstream, for example, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

In a bandwidth extension encoding and/or decoding method, medium, and apparatus, according to one or more embodiments of the present invention, it is possible to encode and/or decode a high-frequency signal by processing the excitation signal extracted from a low-frequency signal. Accordingly, since sound quality of a signal corresponding to a high-frequency region does not deteriorate when audio signals are encoded and/or decoded using a small amount of bits, coding efficiency can be maximized.

While aspects of the present invention has been particularly shown and described with reference to differing embodiments thereof, it should be understood that these exemplary embodiments should be considered in a descriptive sense only and not for purposes of limitation. Any narrowing or broadening of functionality or capability of an aspect in one embodiment should not considered as a respective broadening or narrowing of similar features in a different embodiment, i.e., descriptions of features or aspects within each embodiment should typically be considered as available for other similar features or aspects in the remaining embodiments.

Thus, although a few embodiments have been shown and described, it would be appreciated by those skilled in the art that changes may be made in these embodiments without departing from the principles and spirit of the invention, the scope of which is defined in the claims and their equivalents.

What is claimed is:

1. A bandwidth extension encoding method comprising:

generating, using at least one processing device, a spectrum for frequencies higher than a predetermined frequency of a signal, wherein the spectrum for the frequencies higher than the predetermined frequency is generated from an extracted excitation signal of low-frequencies of the signal through a removal of an envelope from the low-frequencies of the signal; and comparing the generated spectrum with a spectrum of a region, of the signal, whose frequencies are higher than the predetermined frequency, to generate a gain value and adjusting the gain value based on a tonality analysis of the generated spectrum and the spectrum of the region, wherein the tonality analysis comprises comparing a tonality of the generated spectrum and a tonality of the spectrum of the region, the tonality being determined by calculating a Spectral Flatness Measure (SFM) value.

2. A bandwidth extension encoding method comprising:

removing, using at least one processing device, an envelope from a low-frequency signal wherein the low-frequency signal belongs to a frequency region whose frequencies are lower than a predetermined frequency to extract an excitation signal from the low-frequency signal and transform the excitation signal to a frequency domain;

generating a spectrum which belongs to a region whose frequencies are higher than the predetermined frequency by processing a spectrum of the excitation signal;

comparing the generated spectrum with a spectrum of a high-frequency signal corresponding to the region whose frequencies are higher than the predetermined frequency, and calculating a gain value;

calculating a tonality of the generated spectrum and a tonality of a spectrum of the high-frequency signal, and comparing the tonality of the generated spectrum with the tonality of the spectrum of the high-frequency signal, wherein calculating a tonality of a spectrum comprises calculating a Spectral Flatness Measure (SFM) value of the spectrum; and adjusting the gain value according to the result of the comparison.

3. The method of claim 1, further comprising extracting the excitation signal and transforming the excitation signal to a frequency domain, before the generating of the spectrum for the frequencies higher than the predetermined frequency, including extracting the excitation signal from a low-frequency signal, representing the low-frequencies of the signal, by performing Linear Predictive Coding (LPC) analysis on the low-frequency signal to remove the envelope from the low-frequency signal.

4. The method of claim 1, wherein the generation of the spectrum for the frequencies higher than the predetermined frequency further comprises generating the spectrum by folding a low-frequency signal, representing the low-frequencies of the signal, frequencies higher than the predetermined frequency or by symmetrically patching the low-frequency signal to the frequencies higher than the predetermined frequency.

5. The method of claim 1, further comprising encoding the gain value and a determined tonality of the spectrum of the region.

6. The method of claim 1, further comprising generating the gain value by calculating a ratio of a determined energy value for the spectrum for the region with respect to a determined energy value for the generated spectrum, thereby calculating the gain value.

7. A bandwidth extension decoding method comprising:

generating, using at least one processing device, a spectrum for frequencies higher than a predetermined frequency of a signal, wherein the spectrum for the frequencies higher than the predetermined frequency is generated from a spectrum of an excitation signal extracted from the signal by removal of an envelope from low-frequencies of the signal; and decoding a gain value, applying the gain value to the generated spectrum, and processing the spectrum to which the gain value has been applied, based on a comparison of a tonality of the spectrum to which the gain value has been applied and a decoded tonality of a spectrum of a region, of the signal, whose frequencies are higher than the predetermined frequency, wherein the tonality of the spectrum to which the gain value has been applied is calculated by calculating a Spectral Flatness Measure (SFM) value of the spectrum to which the gain value has been applied and the tonality of the spectrum of the region is calculated by calculating a Spectral Flatness Measure (SFM) value of the spectrum of the region.

8. The method of claim 7, further comprising smoothing the gain value.

9. A bandwidth extension decoding method comprising:

removing, using at least one processing device, an envelope from a low-frequency signal wherein the low-frequency signal belongs to a frequency region whose frequencies are lower than a predetermined frequency to extract an excitation signal and transform the excitation signal to a frequency domain;

generating a spectrum which belongs to a region whose frequencies are higher than the predetermined frequency by processing a spectrum of the excitation signal;

decoding a gain value, and applying the gain value to the generated spectrum;

decoding a tonality of a high-frequency signal corresponding to a region whose frequencies are higher than the predetermined frequency, wherein the tonality of the high-frequency signal is determined by calculating a Spectral Flatness Measure (SFM) value;

calculating a tonality of the spectrum to which the gain value is applied, wherein calculating the tonality of the spectrum comprises calculating a Spectral Flatness Measure (SFM) value;

comparing the tonality of the high-frequency signal with the tonality of the spectrum, and calculating an amount of noise that is to be added to the spectrum to which the gain value is applied, according to the result of the comparison; and adding the amount of noise to the spectrum to which the gain value is applied.

10. The method of claim 7, further comprising transforming the excitation signal to a frequency domain by extracting the excitation signal from a low-frequency signal, representing the low-frequencies of the signal, by performing Linear Predictive Coding (LPC) analysis on the low-frequency signal to remove an envelope from the low-frequency signal.

11. The method of claim 7, wherein the generation of the spectrum for the frequencies higher than the predetermined frequency further comprises generating the spectrum by folding a low-frequency signal, representing the low-frequencies of the signal, to frequencies higher than the predetermined frequency or by symmetrically patching the low-frequency signal to the frequencies higher than the predetermined frequency.

12. The method of claim 7, further comprising:

inverse-transforming the spectrum to which the gain value is applied, to a time domain; and synchronizing the decoded low-frequency signal with the inverse-transformed spectrum.

13. A bandwidth extension encoding apparatus comprising:

a spectrum generator generating a spectrum for frequencies higher than a predetermined frequency of a signal, wherein the spectrum for the frequencies higher than the predetermined frequency is generated from an extracted excitation signal of low-frequencies of the signal through a removal of an envelope from the low-frequencies of the signal; and a gain value calculator comparing a region, of the signal, whose frequencies are higher than the predetermined frequency, to generate a gain value and adjusting the gain value based on a tonality analysis of the generated spectrum and the spectrum of the region, wherein the tonality analysis comprises comparing a tonality of the generated spectrum and a tonality of the spectrum of the region, the tonality being determined by calculating a Spectral Flatness Measure (SFM) value.

14. A bandwidth extension encoding apparatus comprising:

an excitation signal extractor removing an envelope from a low-frequency signal wherein the low-frequency signal belongs to a frequency region whose frequencies are lower than a predetermined frequency, to extract an excitation signal, and transforming the excitation signal to a frequency domain;

a spectrum generator generating a spectrum which belongs to a frequency region whose frequencies are higher than the predetermined frequency, by processing a spectrum of the excitation signal;

a gain value calculator comparing the generated spectrum with a spectrum of a high frequency signal corresponding to a region whose frequencies are higher than the predetermined frequency, and calculating a gain value;

a tonality comparator calculating a tonality of the generated spectrum and a tonality of a spectrum of the high-frequency signal, and comparing the tonality of the generated spectrum with the tonality of the spectrum of the high-frequency signal, wherein calculating a tonality of a spectrum comprises calculating a Spectral Flatness Measure (SFM) value of the spectrum; and a gain value adjusting unit adjusting the gain value, according to the result of the comparison.

15. The bandwidth extension encoding apparatus of claim 13, further comprising an excitation signal extractor to extract the excitation signal from a low-frequency signal, representing the low-frequencies of the signal, by performing Linear Predictive Coding (LPC) analysis on the low-frequency signal to remove an envelope from the low-frequency signal.

16. The apparatus of claim 13, wherein the spectrum generator generates the spectrum for the frequencies higher than the predetermined frequency by folding a low-frequency signal, representing the low frequencies of the signal, to frequencies higher than the predetermined frequency or by symmetrically patching the low-frequency signal to the frequencies higher than the predetermined frequency.

17. The apparatus of claim 13, further comprising an encoder encoding the gain value and a determined tonality for the spectrum of the region.

18. The apparatus of claim 13, wherein the gain value calculator calculates a ratio of a determined energy value for the spectrum for the region with respect to a determined energy value for the generated spectrum, and calculates the gain value.

19. A bandwidth extension decoding apparatus comprising:

a spectrum generator generating a spectrum for frequencies higher than a predetermined frequency of a signal, wherein the spectrum for the frequencies higher than the predetermined frequency is generated from a spectrum of an excitation signal extracted from the signal by removal of an envelope from low-frequencies of the signal; and a spectrum applying unit decoding a gain value, and applying the decoded gain value to the generated spectrum; and a processing unit processing the spectrum to which the gain value has been applied, based on a comparison of a tonality of the spectrum to which the gain value has been applied and a decoded tonality of a spectrum of a region, of the signal, whose frequencies are higher than the predetermined frequency, wherein the tonality of the spectrum to which the gain value has been applied is calculated by calculating a Spectral Flatness Measure (SFM) value of the spectrum to which the gain value has been applied and the tonality of the spectrum of the region is calculated by calculating a Spectral Flatness Measure (SFM) value of the spectrum of the region.

20. The apparatus of claim 19, further comprising a gain value smoothing unit smoothing the gain value.

21. A bandwidth extension decoding apparatus comprising:

an excitation signal extractor removing an envelope from a low-frequency signal wherein the low-frequency signal belongs to a frequency region whose frequencies are lower than a predetermined frequency, to extract an excitation signal, and transforming the excitation signal to a frequency domain;

a spectrum generator generating a spectrum which belongs to a frequency region whose frequencies are higher than the predetermined frequency, by processing a spectrum of the transformed excitation signal;

a spectrum applying unit decoding a gain value, and applying the decoded gain value to the generated spectrum;

a tonality decoding unit decoding a tonality of a high-frequency signal corresponding to a region whose frequencies are higher than a predetermined frequency, wherein the tonality of the high-frequency signal is determined by calculating a Spectral Flatness Measure (SFM) value;

a tonality calculating unit calculating a tonality of the spectrum to which the gain value is applied, wherein calculating the tonality of the spectrum comprises calculating a Spectral Flatness Measure (SFM) value;

a noise calculating unit comparing the decoded tonality with the calculated tonality, and calculating an amount of noise that is to be added to the spectrum to which the gain value is applied; and a noise adding unit adding the amount of noise to the spectrum to which the gain value is applied.

22. The apparatus of claim 19, wherein the excitation signal extracting unit extracts the excitation signal from a low-frequency signal, representing the low-frequencies of the signal, by performing Linear Predictive Coding (LPC) analysis on the low-frequency signal to remove an envelope from the low-frequency signal.

23. The apparatus of claim 19, wherein the spectrum generating unit generates the spectrum by folding a low-frequency signal, representing the low frequencies of the signal, to frequencies higher than the predetermined frequency or by symmetrically patching the low-frequency signal to frequencies higher than the predetermined frequency.

24. The apparatus of claim 19, further comprising:

an inverse-transformation unit inverse-transforming the spectrum to which the gain value is applied, to a time domain; and a region synthesizing unit synthesizing the decoded low-frequency signal with the inverse-transformed spectrum.

25. The method of claim 1, further comprising removing the envelope of the low-frequencies of the signal.

26. The method of claim 1, further comprising:

calculating a tonality of the generated spectrum and a tonality of the spectrum of the region, wherein the generating of the gain value includes adjusting a previously calculated gain value, calculated based on a comparison of the generated spectrum and the spectrum of the region, based on the calculated tonality of the generated spectrum and calculated tonality of the spectrum of the region.

27. The method of claim 7, further comprising removing the envelope of the low-frequencies of the signal.

28. The apparatus of claim 13, further comprising an extension signal extractor removing the envelope of the low-frequencies of the signal.

29. The apparatus of claim 13, further comprising:

a tonality calculator calculating a tonality of the generated spectrum and a tonality of the spectrum of the region, wherein the gain value modification unit adjusts a previously calculated gain value, calculated based on a comparison of the generated spectrum and the spectrum of the region, based on the calculated tonality of the generated spectrum and calculated tonality of the spectrum of the region.

30. The apparatus of claim 19, further comprising an extension signal extractor removing the envelope of the low-frequencies of the signal.

31. A high frequency signal decoding method comprising:

obtaining energy values of frequency spectrum from a received bitstream;

generating a noise signal in units of frequency bands in consideration of the obtained energy values of frequency spectrum;

generating a high frequency band by using a decoded low frequency band; and adding the noise signal to the high frequency band.

* * * * *